US005421583A

United States Patent [19]

Gluck

[11] Patent Number: 5,421,583

[45] Date of Patent: Jun. 6, 1995

[54] PRINT MEDIA PRODUCTS WITH ENHANCED REALISM

[75] Inventor: Adrian Gluck, Newport Beach, Calif.

[73] Assignee: Laservision Productions, Inc., Newport Beach, Calif.

[21] Appl. No.: 192,438

[22] Filed: Feb. 7, 1994

Related U.S. Application Data

[63] Continuation-in-part of Ser. No. 147,139, Nov. 3, 1993.

[51] Int. Cl.[6] ..... B42D 15/02; A47G 1/17; A63H 33/38

[52] U.S. Cl. ..... 273/293; 273/282.2; 283/117; 40/160; 40/594; 446/147; 446/901

[58] Field of Search ..... 273/293, 298, 282.2, 273/282.1; 283/56, 117; 40/160, 594, 159; 446/147, 901

[56] References Cited

U.S. PATENT DOCUMENTS

| | | | |
|---|---|---|---|
| D. 326,067 | 5/1992 | Mayers | D11/55 |
| 1,528,475 | 3/1925 | Gaunt . | |
| 1,636,222 | 7/1927 | Fox . | |
| 1,837,707 | 12/1931 | Follows . | |
| 1,987,215 | 1/1935 | Romig . | |
| 2,041,756 | 5/1936 | Gray . | |
| 2,101,683 | 12/1937 | Leigh . | |
| 2,586,039 | 2/1952 | Heggedal | 40/594 |
| 2,731,749 | 1/1956 | Tarzian . | |
| 2,914,873 | 12/1959 | Brennan | 446/901 |
| 3,057,099 | 10/1962 | Fruchter . | |
| 3,137,080 | 6/1964 | Zang . | |
| 3,179,479 | 4/1965 | Freedman . | |
| 3,261,126 | 7/1966 | Marks . | |
| 3,715,816 | 2/1973 | White | 40/594 |
| 3,868,283 | 2/1975 | Scheyer | 156/58 |
| 3,879,874 | 4/1975 | Broussard | 40/158 |
| 4,161,831 | 7/1979 | Restle | 40/160 |
| 4,200,222 | 4/1980 | Feuer | 229/92.8 |
| 4,336,664 | 6/1982 | Penick et al. | 40/594 |
| 4,475,659 | 10/1984 | Wells et al. | 211/55 |
| 4,530,863 | 7/1985 | Seeger | 428/13 |
| 4,601,490 | 7/1986 | Brandon | 283/56 |
| 4,714,275 | 12/1987 | Engel et al. | 281/15 R |
| 4,995,508 | 2/1991 | Burley | 206/455 |
| 5,102,171 | 4/1992 | Saetre | 283/117 |
| 5,103,579 | 4/1992 | Mayers | 40/1.5 |
| 5,152,042 | 10/1992 | Mayers | 29/160.6 |
| 5,190,316 | 3/1993 | Hefty | 281/15.1 |
| 5,269,691 | 12/1993 | Waldman | 434/429 |
| 5,282,649 | 2/1994 | Williams et al. | 283/117 |

OTHER PUBLICATIONS

*Newport News*, Sep. 10, 1992, "It's Once, Twice, Three Times a Trading Card", pp 5–6.

*Primary Examiner*—Benjamin H. Layno
*Attorney, Agent, or Firm*—Lyon & Lyon

[57] ABSTRACT

There is disclosed herein a new form of print media product which provides enhanced realism through a three-dimensional effect. It includes a master sheet or card having a background picture, along with a picture of a person or an object printed or disposed on a substrate and which substrate is directly adhered to the surface of the card to provide a substantially continuous profile edge around the picture and which edge preferably is substantially perpendicular to the surface of the background picture. This arrangement enables a shadow to exist along this profile edge and to give an enhanced three-dimensional effect. In the case of a trading card, the reverse side preferably has detailed biographical information and detailed life sports statistics. In alternative embodiments, the profile item formed by the picture and its substrate can be removable from another object such as a magazine cover. In other embodiments, the profile can have an opening therein, or be in the form of a box or the like, to allow a material object to be inserted and removed therefrom. In each instance, the profile (picture and its substrate) is relatively thin and flexible to allow the object (e.g., trading card, post card, magazine cover, etc.) to be flexed without destroying or deteriorating the combination of the profile and underlying card or other object.

28 Claims, 10 Drawing Sheets

FIG. 3

30

This Is My Life ANTHONY DREW DORSETT

Vital Stats: Ht. 5'11": Wt. - 185 lbs: Shoe - 9 1/2
Family: Born 4/7/54. Rochester, PA: Father (D) - heavy equipment operator, Mother-homemaker;Siblings-four brothers,two sisters, Marital status-single;
Children-one son, twenty years old
Education: Hopewell High School, Class of '73.
University of Pittsburgh, Class of '77,
Career: Drafted by Dallas, 1st round NFL
'77: Played in Pro Bowl '78, '81, '82, '83: NFL record run from scrimmage (99 yards), 1/3/83 against Vikings:
NFC Championship games - '77, '78, '80, '81, '82;
Superbowl XII & XIII: led Broncos in rushing, '88
Third leading rusher in NFL history.
Honors: Heisman Trophy winner, '76; The Sporting News College Player of the Year, '76, The Sporting News NFL Rookie of the year, '77; The Sporting News NFL All-Star team '81.Favorites: Movie-The Sting;
Actress-Jaclyn Smith; T.V. Program-60 Minutes;
Recording Artist-Luther Van Dross;
Book-The Art of War; Food-Soul food; Color-Black;
Car-Mercedes 500SL; Charity-American Heart Assoc.
Geographic Location-Hawaii; Athlete-Muhammad Ali
Biggest Moment: Birth of son
Pastime-Sports; Atheletic shoe-Converse;
Advice: Be Yourself.

34

Current Work:CEO, chemical firm,
Retirement:"I will never retire."
Did you know:Tony's son plays football at the Univ. of Pittsburgh, Tony's Alma Mater.

This Is My Record
Postition: Running Back
Uniform Number :33

Rushing

| Year | Team | Gms | No | Yds | Avg | TD |
|---|---|---|---|---|---|---|
| 1977 | Dallas | 14 | 208 | 1007 | 4.8 | 12 |
| 1978 | Dallas | 16 | 290 | 1325 | 4.6 | 7 |
| 1979 | Dallas | 14 | 250 | 1107 | 4.4 | 6 |
| 1980 | Dallas | 15 | 278 | 1185 | 4.3 | 11 |
| 1981 | Dallas | 16 | 342 | 1645 | 4.8 | 4 |
| 1982 | Dallas | 9 | 177 | 745 | 4.2 | 5 |
| 1983 | Dallas | 16 | 289 | 1321 | 4.5 | 8 |
| 1984 | Dallas | 16 | 302 | 1189 | 3.9 | 6 |
| 1985 | Dallas | 16 | 305 | 1387 | 4.3 | 7 |
| 1986 | Dallas | 9 | 184 | 748 | 4.1 | 5 |
| 1987 | Dallas | 16 | 130 | 456 | 3.5 | 1 |
| 1988 | Denver | 16 | 181 | 703 | 3.9 | 5 |
| Totals | | 164 | 2936 | 12739 | 4.3 | 77 |

019680

35 36

PRINT MEDIA PRODUCTS WITH ENHANCED REALISM

CROSS-REFERENCE TO RELATED APPLICATION

This application is a continuation-in-part of application Ser. No. 08/147,139 filed Nov. 3, 1993.

The present invention relates to print media products for providing enhanced reality. The products can include trading cards, postcards, magazine covers, book covers, display boxes such as for food products, covers for video tapes, laser discs and the like, and various others.

BACKGROUND OF THE INVENTION

It is desirable in many instances to obtain some form of immediate visual impact. This can be readily obtained through television, video productions, motion pictures, and the like. Unfortunately these media are not susceptible of the many and diverse uses of print media such as portability, compactness and the like because they simulate reality through the use of motion pictures. However, products involving the print media have not been changed in any significant extent for years.

Enhanced realism has been tried through the use of colorful packages and covers such as those found on magazines and books, the use of holography on trading cards, and in other ways. Considering trading cards as an example, premium type cards have been developed in recent years which use high quality lithography. Some cards are printed on glossy cardboard stock with crisp color photographs of a player on the front and back. Other products, such as postcards, have included 3-D pictures, holograms and embossing to enhance the realism of the pictures.

There are many applications where there is a need for something to provide a sense of enhanced reality. High quality photography, 3-D photographs, and holography to some extent partially achieve this objective; however, many of the past attempts have been viewed only as novelties and have, in fact, reduced the realism of the scene. For example, a trading card display case manufactured by TRI Cards, has been promoted and includes cut portions of cards layered with bits of wood on top of a base card and off-set in an enclosure case made of plastic material to attempt to make the player appear to be moving. Scheyer, U.S. Pat. No. 3,868,283, discloses an attempt to provide a three-dimensional picture, not a trading card, in which portions of a photograph are spaced away from a background by a lightweight piece of spacial material. It is a relatively bulky item compared to the usual thin and flexible trading card, and only appears to be a novelty item due to the unnatural placement of the subject versus the background. The viewer can easily determine that the object is not realistic by viewing it from a different angle than 90° and by seeing the edges.

SUMMARY OF THE INVENTION

Although attempts such as those noted above have been made to provide more realistic products or pictures, it has been found that the spacing of a picture away from a background as previously proposed does not provide either a realistic rendition of the original subject or a pleasing effect. On the other hand, it has been found that providing a relatively thin cutout profile of a player or object disposed, as by bonding, directly onto a background scene or photograph, preferably including the same view of the player or object and precisely aligned with the underlying player or object and with the profile, thus being directly adjacent to the background and having a relatively sharp edge on the profile, provides a shadow effect around the player or object and gives a greatly enhanced realism to the picture, thus making it appear more like the original scene from which the picture was taken. The concepts of the present invention are applicable to various forms of print media such as trading cards, postcards, advertising cards, magazine covers, book covers, food and other product containers, recorded media packages such as laser disk, compact disk and video tape packages, post cards and others. The applications include products or devices where there is a need for immediate visual impact and can include any picture or object where dimensionality is important, that is, where the picture gains by providing some dimensionality. It can be particularly useful with regard to products that are displayed for retail sale where some form of visual impact is needed or helpful, such as boxes on stands, on shelves, including various forms of food and other products. The applications include post cards, greeting cards, covers for magazines and books, store "shelf talkers," and other applications where it is desired to have an impact on a casual shopper.

Furthermore, the concepts of the present invention are useful where it is desirable to provide or gain additional information such as in the case of pictures of athletes on trading cards, magazines and the like where it is helpful to illustrate the person's size, size and shape of muscles, pleasing figures, animals, graphical features such as mountains and arches, tourist attractions, educational materials and the like where the extra dimension provided by the present invention can be helpful. Although the print media has been relatively static for many years, the present invention can provide an awakening of interest in packaging, covers and the like.

Even further, the foreground picture or object can be provided in such a manner that it can be peeled off from the background for other uses and without destroying the background. For example, a magazine cover may have a "peel-off" photograph on a substrate, according to the present invention, of a sports figure, and wherein the background can remain intact and with an underlying identical sports picture. The peel-off picture can be applied elsewhere as desired, as in a scrapbook, on a school book, etc. As a futher alternative, the foreground picture or object can be multi-layered, such as a helmet on a football player, or the foreground picture or object can be hollow to allow it to hold another object, such as eggs in a chicken, etc.

In most instances, it is very important that the substrate and profile picture combination be flexible so that the product involved, such as a magazine, can be folded (e.g., for shipment). The combined thickness of the substrate and profile picture is very important and preferably in the range of three to twenty thousandths of an inch thickness per one inch of length measured at the longest points of the image as will be further discussed.

Accordingly, it is a principal object of the present invention to provide a print media product, and method, for providing a three-dimensional effect so as to give a sense of enhanced reality regardless of the angle of viewing.

Another object of the present invention is to provide an improved form of trading card, post card or greeting card.

A further object of the present invention is to provide a print media product with a pleasing three-dimensional effect.

Another object of the present invention is to provide a print media product including a magazine cover with a peel-off profile which, prior to peeling the same off, provides the cover with a three-dimensional effect.

Another object of this invention is to provide a print media product having a three-dimensional effect wherein a foreground profile cutout of the person or object is bonded directly to a master substrate which provides a background.

A further object of this invention is to provide an improved trading card having detailed personal information and detailed statistical information on one side of a trading card, and a foreground profile likeness of the person on the other side.

BRIEF DESCRIPTION OF DRAWINGS

These and other objects and features of the present invention will become better understood through a consideration of the following description taken in conjunction with the drawings in which:

FIG. 3 is a view showing the layout of the reverse side of the trading card of FIG. 1;

DETAILED DESCRIPTION

Figure 1:
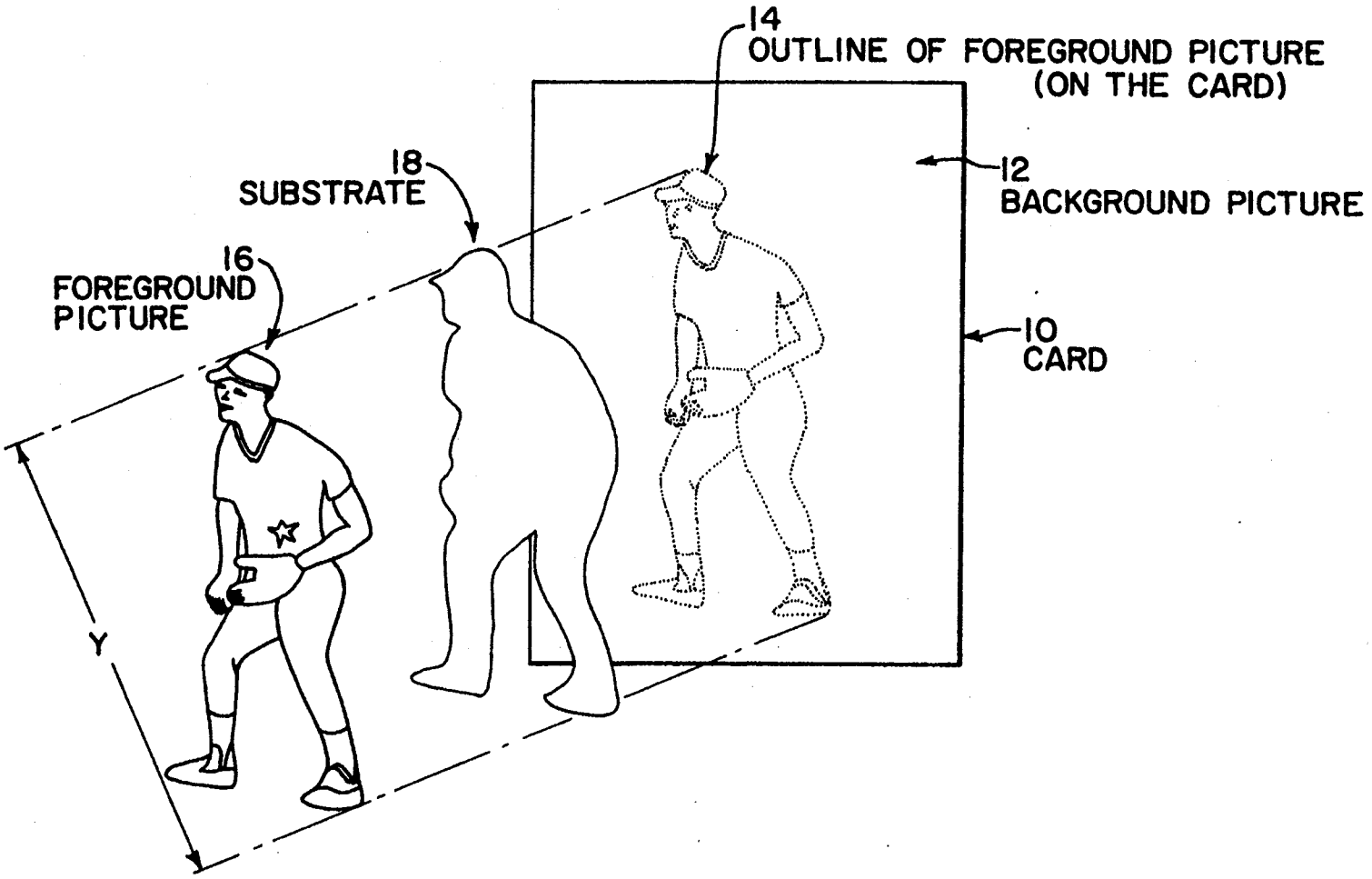
FIG. 1 is an exploded perspective view of a trading card with a three-dimensional effect according to the present invention.

According to one embodiment of the present invention, a trading card is provided of the usual basic composition having a master card substrate with a background picture preferably including an action likeness of the player on a first side, and biographical, statistical and family information printed on the second side thereof. In addition, according to the present invention, a foreground profile picture is disposed on a thin backing or substrate, and the substrate is directly bonded in intimate contact to the background picture and preferably directly aligned with a like action picture of the player. Further, the edge of the foreground picture and its substrate preferably is perpendicular or close to perpendicular so as to not only slightly space the foreground picture from the background picture but to provide a shadow or shadow effect along the edge of the foreground picture which enhances and provides a three-dimensional effect from any angle of viewing. The foreground picture and its backing or substrate preferably is no thicker than the underlying master card and no more than three to twenty thousandths inch per one inch of length measured at the longest points of the image. The second side of the card according to the present invention includes detailed biographical information of the individual portrayed on the first side of the card, as well as a detailed statistical information of the sports career (e.g., the baseball career) of the individual, a serial number, and can also include a small family picture if desired. This information enables the readers to get closer in their minds to the player depicted on the front of the card.

Other aspects of the present invention include providing a profile picture (picture and its substrate) of a person or object on a piece of cardboard, plastic or the like, such as a postcard or greeting card, as an integral part of a package for a product, as a magazine, book or container cover or the like. It can include an advertising postcard or the like.

The principal objectives of the present invention are to enhance the realism of a product, and particularly an already familiar two-dimensional surface of a product, by making the picture of a person or object appear three-dimensional to provide a sense of enhanced reality regardless of the angle of viewing. This is accomplished primarily by slightly moving the picture away from the background and providing a solid, mostly perpendicular edge to the picture. The picture is moved away from the background by the thickness of the picture and its substrate. In the case of a trading card, all other elements of a high quality card are maintained essentially the same (with the exception of significant changes to the opposite side of the card as discussed subsequently).

The edge of the foreground profile, be it of a person or an object, which edge is principally provided by the substrate onto which the foreground picture is printed or laminated, preferably is relatively sharp and an approximately ninety degree edge with respect to the overall card so as to provide a shadow and increase the three-dimensional effect. This edge can be sloped slightly either outwardly or inwardly with the former helping to keep someone from normally popping the profile picture off of the card with the fingernail and for easier sliding into envelopes, sleeves, etc., but approximately ninety degree edge is preferred.

Alternatively, in certain other applications such as on magazine and book covers or on some packaging, it can be desirable to have a removable profile, such as of a sports figure on a sports magazine, and in this instance it is desirable to facilitate removal of the profile. This can be accomplished as will be discussed later by providing the basic background picture with the person or object thereon (e.g., the paper of the magazine cover), and then providing an overlying profile of the person or object but with an adhesive backing which allows removal of the profile: from the underlying like person or object. This embodiment is particularly useful to both accomplish the objective of providing the three-dimensional effect, and also allowing removal of the profile for other uses, such as sticking the same onto a scrapbook, poster, other object or the like. The back side of the profile, or the empty space left on the cover itself, can include other information, if desired, such as an advertisement.

In the case of trading cards, it is important to maintain the general trading card format so as to take advantage of the substantial trading card market that has been developed. Further, it is desired to maintain the overall thickness of the card close or similar to that of current cards, to minimize obstacles to inserting the card into industry standard holders or sleeves, to keep the general look and feel of the card familiar, and to make the card as durable as existing cards.

Furthermore, an objective is to provide a card which itself can provide a reference (and as a group provide a reference set for a number of sports players) of detailed biographical information of the person, substantially all of the lifetime statistics for the person, and possibly some personal family information or picture. Thus, in an exemplary embodiment, the second side of a trading card of the present card includes this information.

Exemplary manufacturing and processing techniques for manufacturing a product according to the present invention involve use of conventional trading card manufacturing equipment and techniques, as well as new techniques. For example, an action shot of the subject is taken and suitably recorded, preferably electronically in analog or digital form. The entire picture including the subject person and background is printed onto paper or cardboard sheets in the form of multiple pictures in a conventional manner usually using sheet-feed lithography. In order to accommodate for machine, temperature, humidity, alignment and other errors, the edges of the profile player, if present on the background, are bled inward on the background up to about one-eighth inch. Likewise and for the same reasons, the edges of the profile of the player are bled outward up to about one-eighth inch. Then the entire picture (subject and background) is printed on thin film and affixed to plastic, paper or cardboard sheets or printed directly on plastic, paper or cardboard sheets and serves as the basic member for the foreground profile. The electronic image data of the action shot of the person is fed into a laser die-cutting or die cutting mold system to respectively either laser die cut the photograph of the person along its outline (profile) from the plastic, paper or cardboard sheet or this information can be used to manufacture a cutting mold for similarly cutting the outline or profile of the person. Then the cut foreground profile is bonded in a suitable manner to the master sheet having the background preferably in precise alignment with the like profile of the subject in the background picture. Bonding can be accomplished in any suitable manner as with a suitable spray, liquid or tape adhesive, heat or ultrasonic bonding, or the like. The individual trading cards are cut from the composite (foreground and background) either before or after bonding the foreground profile. Finally, the resulting cards are packaged either individually or into groups of multiple cards in a conventional manner.

To facilitate the placement of the foreground profile exactly in position on the background, the foreground profile can be printed on the back of a double card and kiss-cut such that, after die-cutting, it can be simply folded over the background.

If the profile is to be a "peel-off" item, it also has a suitable adhesive, such as like that of the Post-It TM brand from 3M, applied to its back side to allow its release from the underlying substrate (e.g., cover of a magazine). Standard laminating processes are used.

Inasmuch as the profile has a finite thickness, albeit small, it can be made hollow for holding a picture or rendering of a related object, or a magnetic or semi-conductor object onto which is stored data such as sports statistics. For example, in the case of a cover for a children's book or magazine, the profile can be a chicken on a farmyard background and the profile can hold the picture of an egg or eggs which can be removable by a child. As an alternative, the profile can be in the form of a very thin box with a lid so that the cover picture of the profile can be hinged open to expose a picture or other item within the box formed by the profile. All these additional features can enhance the realism of the scene depicted.

It has been found that there are important criteria for products made according to the concepts of the present invention, and these include the following. First, it is important that there not be too much (in area) of the foreground subject (person or object) as compared to the area of the background. That is, for example, in the case of a trading card, post card, or the like, it is preferable that the picture of a person or object, (1) be cut or otherwise formed to the profile of that person or object and (2) to not occupy more than approximately seventy-five percent of the background.

It is important that both the material on which the background is formed or otherwise provided and the foreground profile person or object (picture and the substrate) thereon be relatively thin and flexible. This is particularly important in the case of a magazine cover so that the cover can be opened as usual without difficulty.

Furthermore, a thinner and flexible product is lighter, thus involving less shipping costs, and also allowing folding for shipment, carrying by the reader, or storage. A typical range is three to twenty thousandths of an inch thickness per one inch of length measured at the longest points of the image.

It is particularly important to use a familiar foreground subject for the profile, generally something that has already been seen and/or is familiar in two dimensions. This can enhance the sense of realism when a familiar two-dimensional subject is provided with a three-dimensional effect—it relieves the monotony of a two-dimensional surface.

It is desirable that the foreground subject be perfectly aligned onto an identical subject on the background, although this is not necessary in all instances. This is particularly desirable for a product such as a magazine cover and wherein the foreground profile is in a peel-off form as discussed earlier so that the profile can be peeled off for whatever use is to be made of it while leaving the identical picture on the magazine cover.

Finally, it is preferable for maintaining the realism effect not to include a frame or other extraneous matter (meaning other than the foreground subject) on the product. Although a frame or border can facilitate insertion of a profile trading card, according to the present invention, into a plastic sleeve, the frame or border tends to reduce the realism of the image and the angles of viewing.

Figure 2:
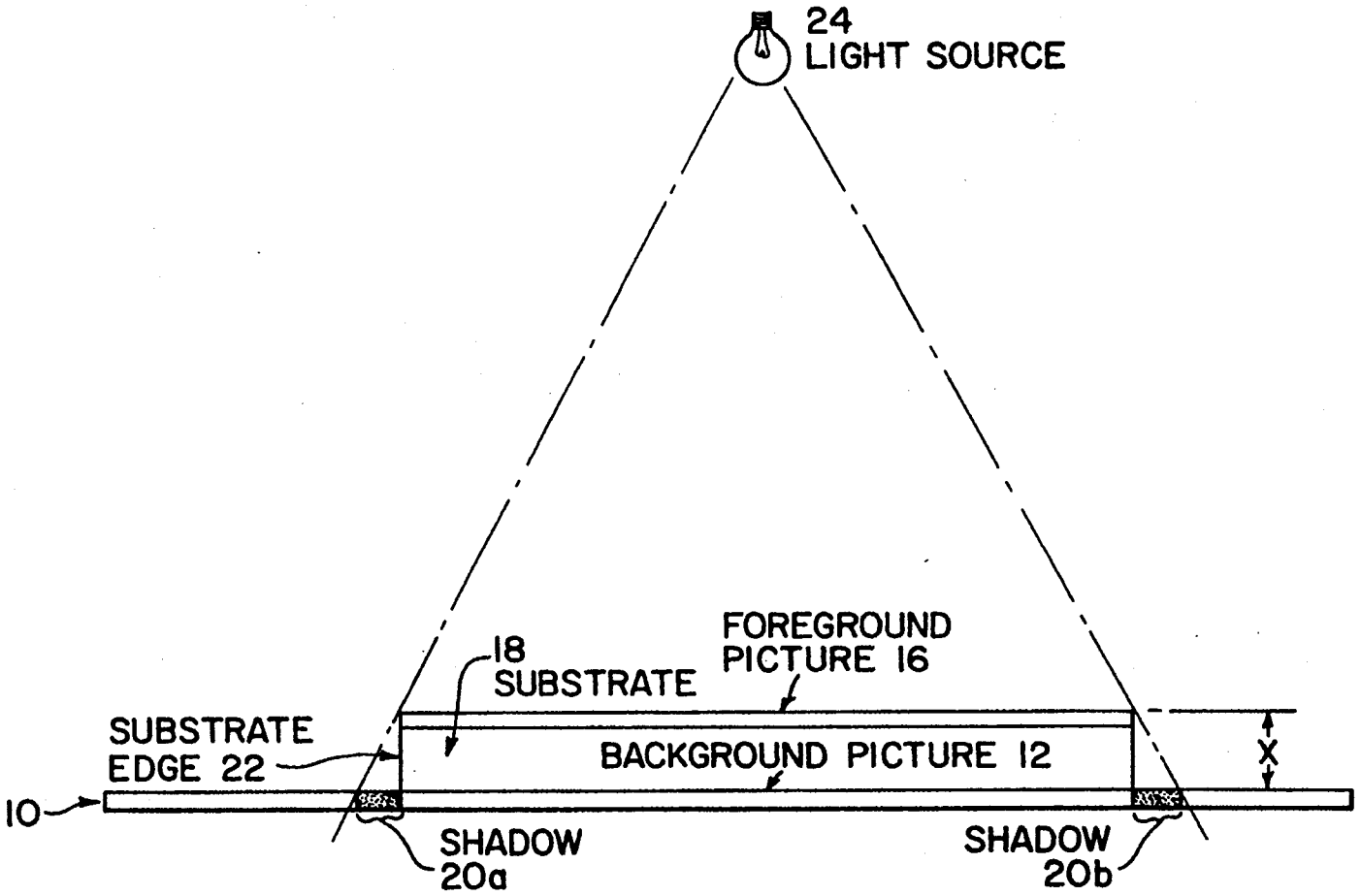
FIG. 2 is a side or cross-sectional view of the trading card of FIG. 1.

Turning now to the drawings, and first to FIGS. 1 through 3, the concepts of the present invention will first be described with regard to cards such as trading cards. These FIGS. 1–3 illustrate a card with a three-dimensional effect according to the present invention, with FIG. 1 essentially illustrating the first side of the card, FIG. 3 illustrating the second side of the card, and FIG. 2 illustrating a cross-sectional view of the composite card. The master card is illustrated at 10 and is essentially a conventional trading card having a background picture 12 usually including an action picture 14 of the subject player. The card 10 thus far is manufactured according to conventional trading card techniques such as those noted earlier (and, alternatively, can be another conventional print media product such as a post card, magazine cover, package, etc.). A copy or identical foreground picture 16 of the subject as shown at 14 is provided on a substrate 18 and bonded to the first surface of the card 10 as seen in FIG. 1 aligned with the subject player picture 14. The foreground picture 16 is typically printed directly onto the substrate 18, and the substrate 18 bonded, as by a suitable adhesive, to the card 10.

This assembly results in the flexible print media composite card as shown in FIG. 2 which essentially is a cross-sectional view of the card 10 having the background picture 12 printed thereon, along with the substrate 18 bonded to the card 10 and with the substrate 18 having the foreground picture 16 either printed directly thereon or laminated from a photograph thereon. The substrate 18 can be paper, cardboard, plastic or the like.

It is important that the surface of the foreground picture 16 be only slightly spaced outwardly from the background picture 12 on the card 10, and a typical distance "X" between the surface of the foreground picture 16 and the surface of the background picture 12 is forty thousandths of an inch or within the range of approximately three to twenty thousandths of an inch thickness per one inch of length measured at the longest points (e.g., "y" on FIG. 1) of the image 16. Likewise it is important that the substrate 18 have the identical or aligned profile or outline of the picture 16. This can be accomplished by bonding the picture 16 to the substrate 18 and then cutting around the profile of the person in the picture to form this profile edge. This ensures an accurate profile of the player as well as a substantially continuous profile edge around the player. The above dimensions are applicable to all of the embodiments of the present invention.

This structural arrangement enables a slight shadow as indicated at 20*a* and 20*b* from light 24 to exist around the edge 22 of the substrate 18 and picture 16 which enhances the three-dimensional effect without, in turn, causing an unrealistic or unattractive effect obtained from spacing a foreground picture away from the background in the manner disclosed in the prior art. Also, spacing the figure discloses easily to the viewer the fact that it is printed in two dimensions because the edges of the material on which the picture is printed can be easily seen. Although the substrate edge 22 can angle outwardly or angle inwardly (undercut), it is preferred that this edge be approximately perpendicular as illustrated in FIG. 2 which provides the best shadow effect without providing essentially a gap (as would exist if the edge 22 were angled inwardly or undercut) which would more easily allow the profile picture 16 to be pried off the card 10 or cause an undercut edge to catch when inserting the completed card into a sleeve.

The second or reverse side of the card 10 preferably has printed thereon information which is substantially different from that of the conventional trading card. According to the present invention, this side of the card is similar to that shown in FIG. 3 and includes a first section 30 having detailed life history information of the subject. A second section 34 includes detailed statistical information about the person such as illustrated various averages, runs, hits, etc. for the several teams the player has played with over his career. This provides substantial information for the recipient of the card rather than the relatively sketchy information provided by conventional trading cards. A serial number 35 also can be provided.

Also, this section 34 preferably includes coded information 36 in the form of bar code, magnetic, or other optical or electronically readable information. The coded information can include all of the statistical information in section 34 and/or other information that may be desired. A suitable reader for retrieving this information can be provided for inputing this data into any type of electronic data display device for the purpose of displaying this data.

In addition to providing cards, the concepts of the present invention can be applied in other print media areas, such as photographs, postcards, greeting cards, magazine and book covers, packaging for products and the like. For example, the realism of regular photographs either of individuals or of scenes can be enhanced by applying the techniques disclosed herein to provide a three-dimensional effect. Features of a scene, such as St. Peter's Square, or an individual standing there, can be enhanced by providing a foreground picture such as picture 16 on a substrate 18 like shown in FIG. 1. Photographs of children, family members, individuals, groups, and the like can be provided in a composite card form as shown in FIG. 1–2.

A postcard formed like that of FIG. 1 can be provided as an advertising postcard. The profile 16, 18 can be of a sports person, and the back side of the card (like FIG. 3) can include the biographical information about all players on his team. An example could be a football player profile on the front and some advertising material, and a biography of all football players of both teams for an upcoming game (with or without an advertising message). Alternatively, in this case, the advertised product could be the profile and replace the player on the front.

Figure 4:
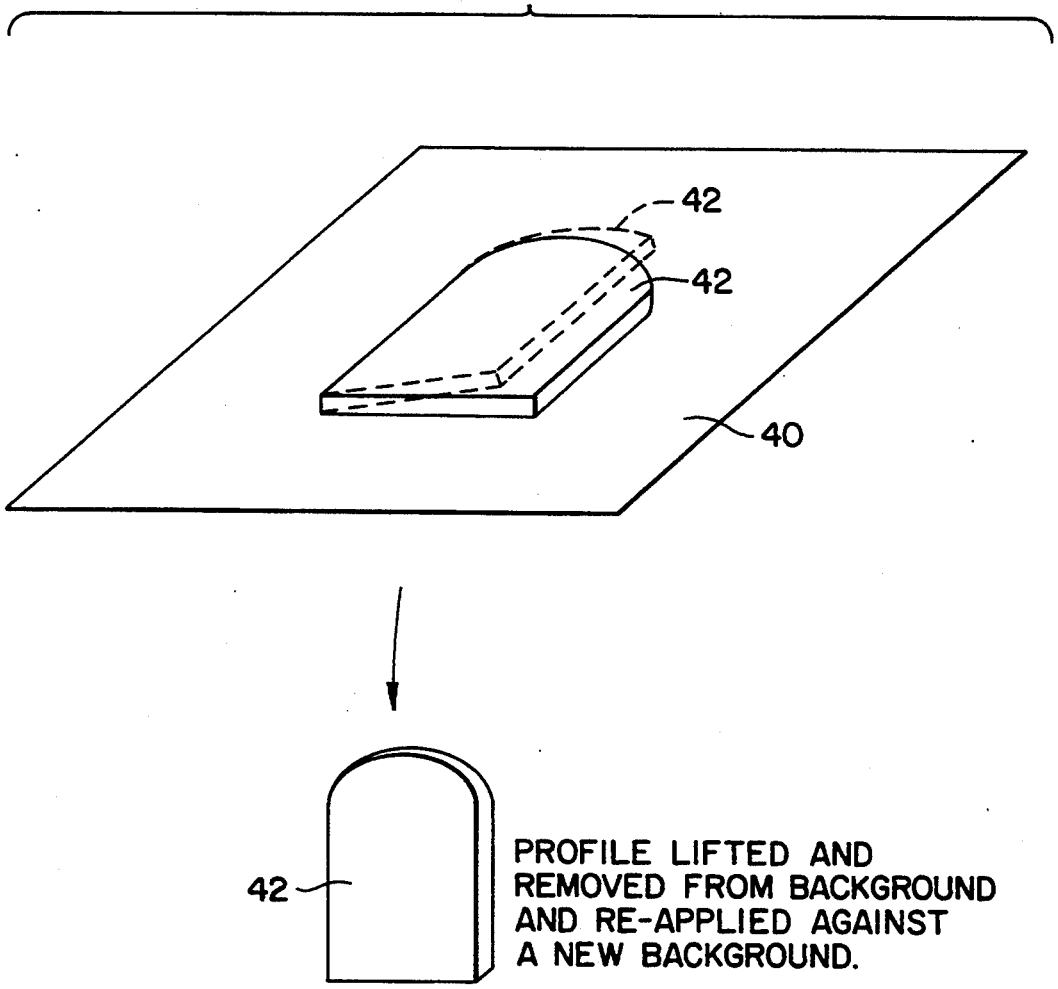
FIG. 4 is a perspective view of a "peel-off" profile on a background such as a magazine cover, trading card, or other object.
Figure 5:
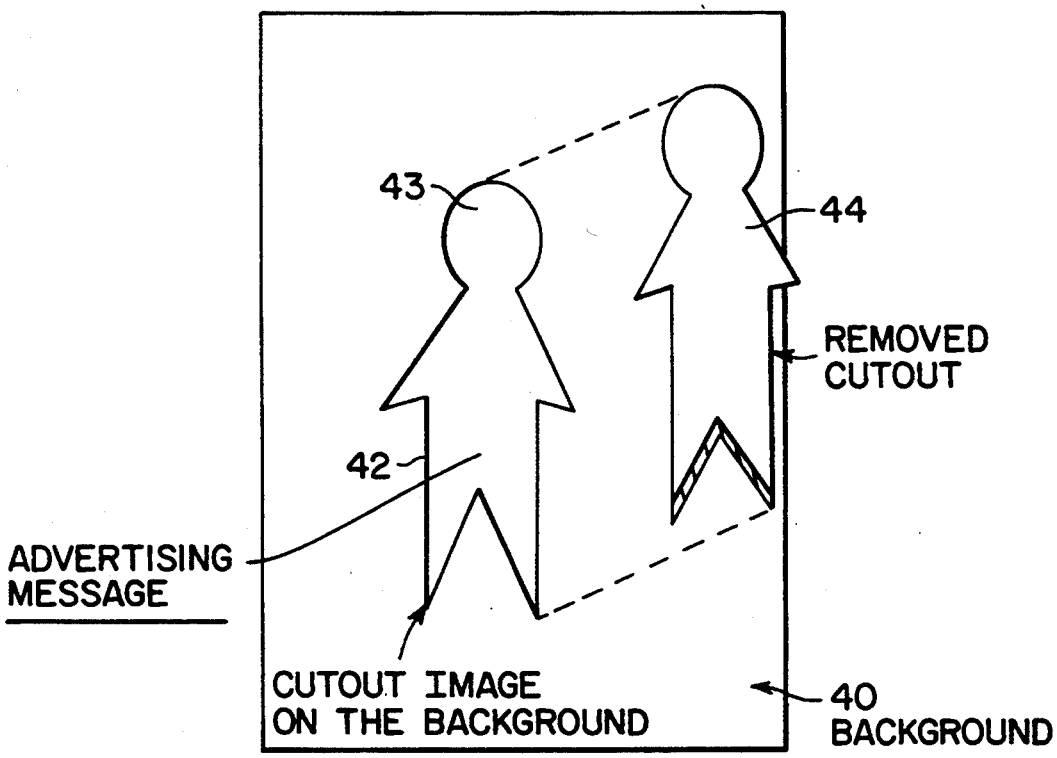
FIG. 5 is a view illustrating a "peel-off" profile, such as on a magazine cover, of the present invention with advertising on the back thereof.

An alternative embodiment of the concepts of the present invention is illustrated in FIGS. 4 and 5. Here, the background 40 is shown with a profile 42 (picture and its substrate, like 16 and 18 of FIG. 1), but wherein the profile 42 is in the form of a cut-out image that can be removed from the background 40. The back surface 43 (note FIG. 5) of the profile 42 has a suitable adhesive to allow this "peel-off". Furthermore, the back surface may include an advertising message on that surface 43 as shown in FIG. 5. The profile and background are otherwise like those previously discussed.

Figure 6:
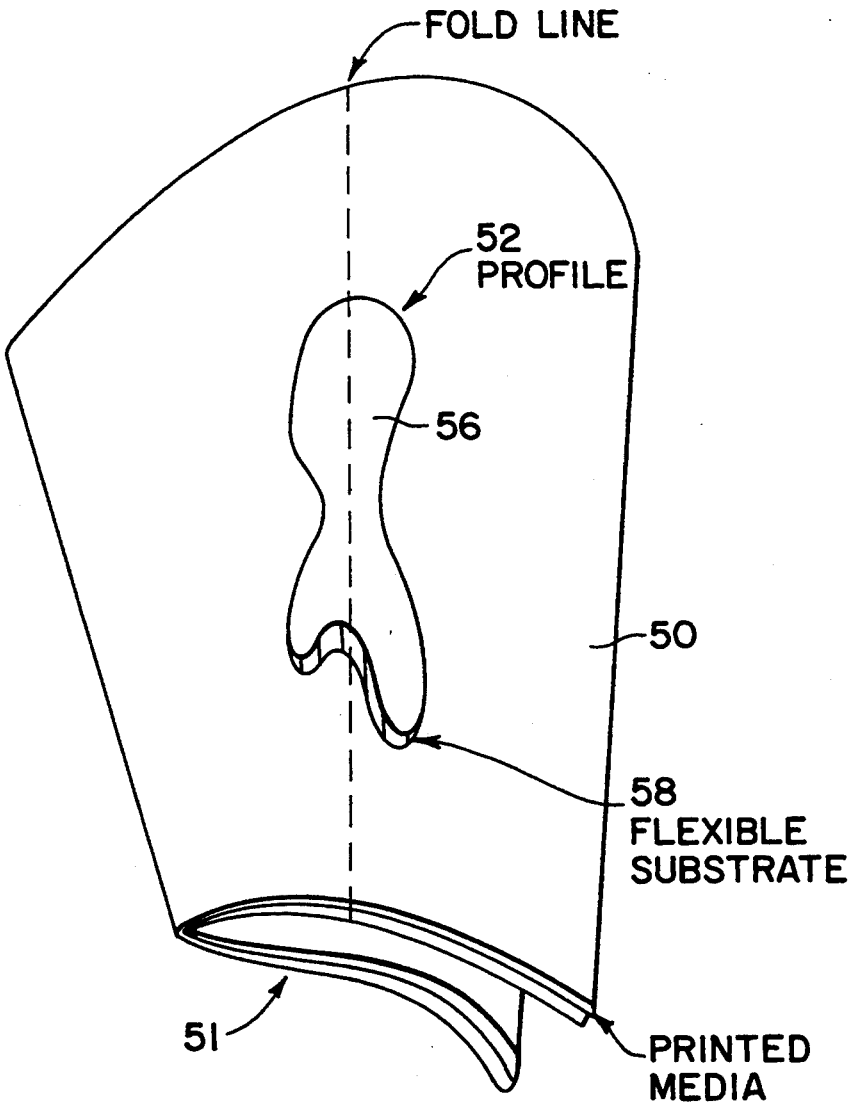
FIG. 6 is a perspective view of a print media item, such as a magazine, wherein the print media is flexible and the profile and its substrate are flexible to allow folding of the print media product.

FIG. 6 shows a profile 52 on a background 50 and wherein the background 50 is in the form of a cover of a magazine 51. One of the purposes of this Figure is to illustrate the desirability of the profile 52 (comprising an image of a person or object 56 on a substrate 58) being flexible to allow the cover 50 and the rest of the magazine 51 to be folded as desired and without ruining or popping off the profile 52 as would occur if the profile (56 and 58) where not relatively flexible.

Figure 7:
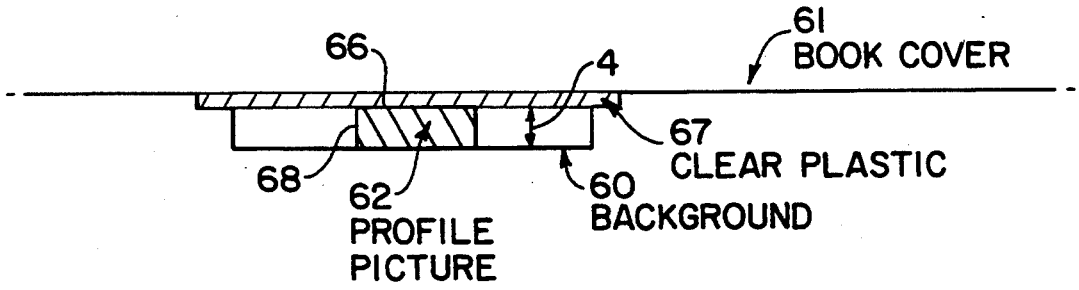
FIG. 7 is a cross-sectional view of a book cover incorporating the concepts of the present invention.

FIG. 7 illustrates an embodiment of the present invention as applied to a book cover 61 wherein a profile picture 62 is disposed on a background 60, and the profile comprises a substrate 68 and image 66 of a person or object as previously described. In this embodiment, the profile 62 and background are inset as illustrated at Y into the book cover 61 and are covered by a clear plastic covering 67.

Figure 8:
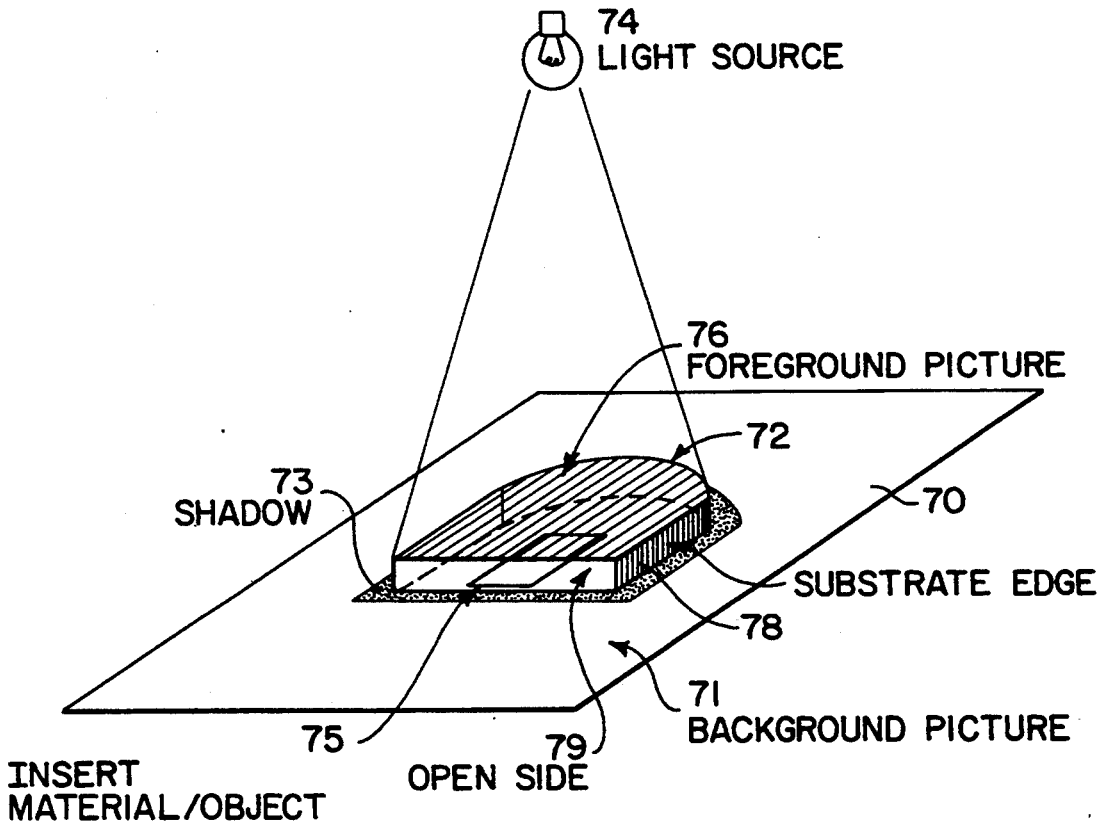
FIG. 8 is a perspective view of a product according to the present invention with a foreground profile on a background picture, and wherein the profile provides an opening for holding a material or object.
Figure 9:
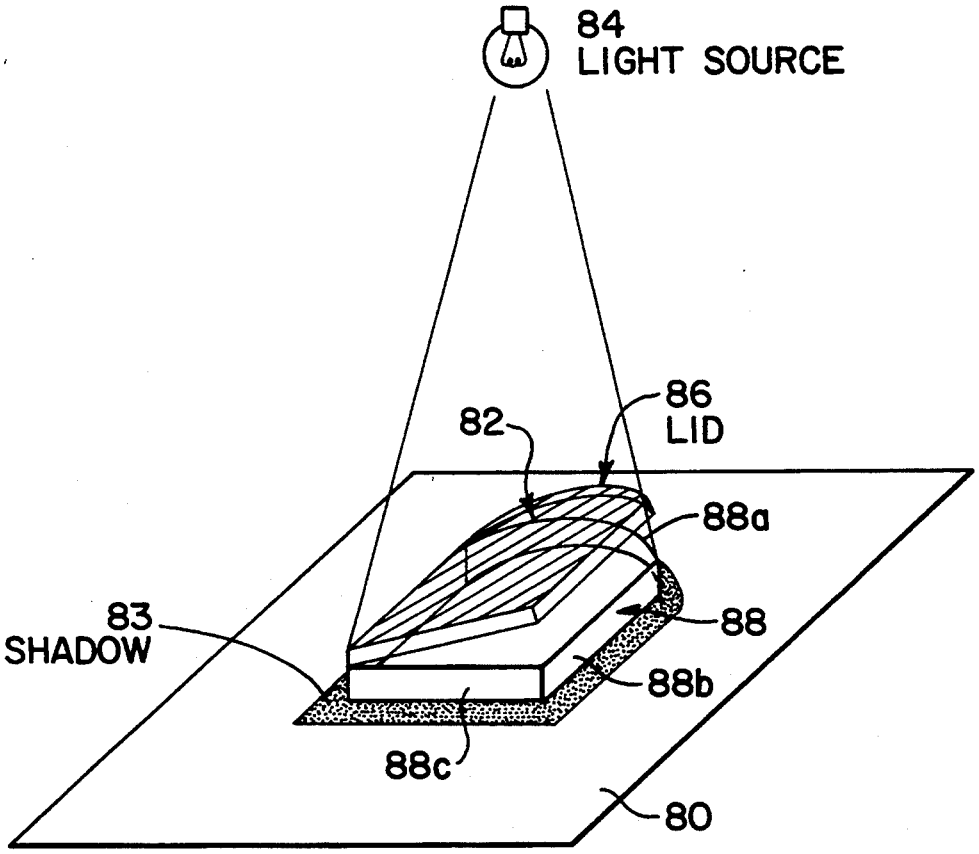
FIG. 9 is a perspective view of an alternative embodiment wherein the profile is in the form of a thin box.

The embodiments of FIGS. 8 and 9 illustrate profiles 72 and 82 wherein the profile is constructed to store an object within the profile. In the arrangement shown in FIG. 8, the profile 72 is disposed on a background 70. The profile 72 includes a foreground picture 76 and a substrate 78, but in this embodiment the substrate 78 has an opening therein accessed from an open side 79 and into which a material or object 75 can be disposed so as to enhance the realism of the scene. An example could be a foreground picture 76 of a chicken on a farmyard background picture 71, and wherein the insert 75 is an egg or eggs. This Figure also shows the shadow 73 provided when light from a light source shines on the combination and occurs because of the thickness of the profile (or the spacing of the foreground picture 76 from the background 70 as provided by this thickness).

FIG. 9 illustrates an embodiment wherein the profile 82 is in the form of a box wherein the lid comprises the foreground picture, and the substrate 88 is in the form of the sides 88*a*, 88*b*, 88*c*, etc., of the box. This arrangement allows some object likewise to be inserted into the thus-formed box while still providing the shadow effect and the three-dimensional effect because of the spacing of the foreground picture from the background 80.

Figure 10A:
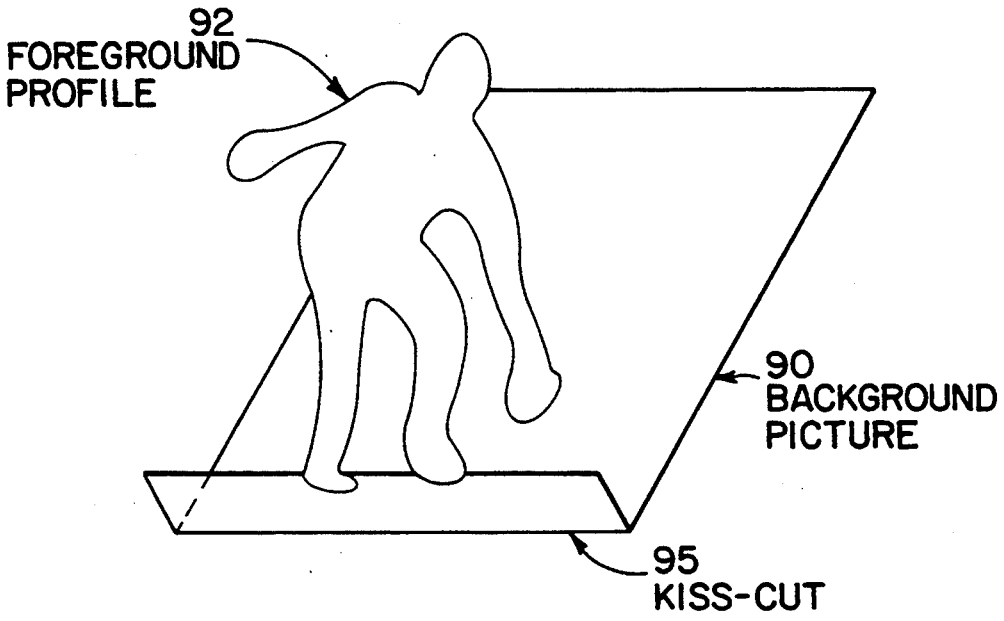
FIG. 10*a* and 10*b* are a perspective view and end view of a die-cut card with the profile attached and being folded into place.
Figure 10B:
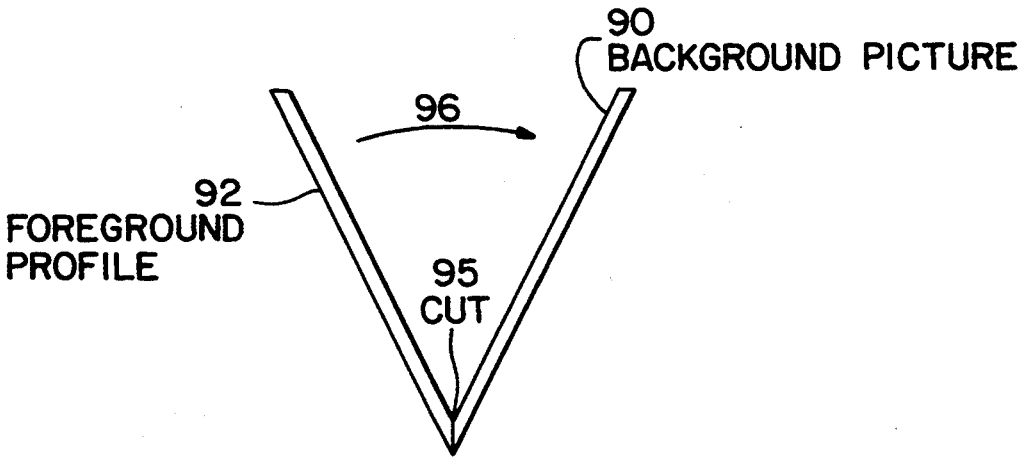

FIGS. 10*a* and 10*b* illustrate the manner in which accurate placement of the foreground profile on the background can be accomplished, with FIG. 10*a* being a perspective view of a background picture and foreground profile, and FIG. 10*b* being a cross-sectional or end view of the assembly of FIG. 10*a*. In this arrangement, a single sheet or double die-cut card can have the background picture 90 printed on one side as indicated in FIG. 10*b* and the foreground profile 92 on the other side and die-cut as illustrated in FIG. 10*a*. A kiss-cut 95 is provided to allow the die-cut foreground profile 92 to be folded up in the direction of arrow 96 to overlay the background picture 90. This can facilitate the placement of the foreground profile 92 exactly in position on the background picture 90.

While embodiments of the present invention have been shown and described, various modifications may be made without departing from the scope of the present invention, and all such modifications and equivalents are intended to be covered.

What is claimed is:

1. Print media with enhanced realism via a three-dimensional effect comprising a sheet having on a first surface thereof a background picture, and a foreground picture of a person or object on a substrate which is cut to form a profile of the person or object and forming a profile edge substantially all of which is adhered directly to the first surface of the sheet, the foreground picture being on a surface slightly spaced by the substrate from the background picture, and the substrate providing a substantially continuous profile edge aligned with the profile of the person or object which is substantially perpendicular to the first surface of the sheet and which, when illuminated, provides a shadow around the foreground picture to provide a three-dimensional effect.

2. Print media as in claim 1 wherein the substrate is bonded directly over and aligned with a picture of a person or object in the background which is substantially identical to the foreground picture.

3. Print media as in claim 1 wherein said profile edge is perpendicular to the first surface of the sheet.

4. Print media as in claim 1 providing a card of the trading card type wherein the foreground picture is of a sports figure and the sheet has a second surface, the second surface having printed thereon a first section containing detailed lifetime biographical information of the person, and a second section containing substantially lifetime sports statistics for the person.

5. Print media as in claim 4 wherein the thickness of the foreground picture and substrate is within the range of three to twenty thousandths of an inch thickness per one inch of length measured at the longest points.

6. Print media as in claim 1 wherein said sheet comprises the cover of a magazine.

7. Print media as in claim 6 wherein the substrate is adhered to the sheet by an adhesive which allows the substrate to be peeled off from the sheet for attachment to another object.

8. Print media as in claim 7 wherein a surface of the substrate adhered to the sheet by said adhesive itself contains print media.

9. Print media as in claim 8 wherein the print media on the adhered surface of the substrate comprises advertising.

10. A print media as in claim 6 wherein the thickness of the image and substrate are within the range of three to twenty thousandths of an inch thickness per one inch of length measured at the longest points.

11. Print media as in claim 1 wherein the thickness of the foreground picture and substrate is within the range of three to twenty thousandths of an inch thickness per one inch of length measured at the longest points.

12. Print media as in claim 1 wherein the substrate has an opening therein to allow an object to be inserted within the substrate and underneath the foreground picture.

13. Print media as in claim 1 wherein the substrate has sides with an open area between the sides, and the foreground picture forms a hinged cover for the sides to thereby form a box-like container.

14. Print media as in claim 1 wherein the sheet comprises a book cover and has an inset cavity therein having a bottom which provides said first surface, and further including a clear plastic cover over the foreground picture and substrate within the inset cavity.

15. Print media as in claim 1 wherein the sheet has a second surface having printed thereon a compilation of biographical information of a sports team.

16. Print media as in claim 1 wherein the substrate is adhered to the sheet by an adhesive which allows the substrate to be peeled off from the sheet for attachment to another object.

17. Print media as in claim 1 wherein the substrate is bonded over a picture of a person or object in the background which is substantially identical to the foreground picture.

18. Print media as in claim 17 providing a card of the trading card type wherein the foreground picture is of a sports figure.

19. A profile print media cover comprising an image adhered to a magazine or book cover having a background, the image comprising an image of an action photograph of a sports player, the image being bonded on a substrate, and the image and the substrate being cut around a profile of the player, the edge of the image and the substrate being substantially aligned and perpendicular to the surface of the image and forming a substantially continuous profile edge, the thickness of the image and substrate being within the range of three to twenty thousandths of an inch thickness per one inch of length measured at the longest points.

20. A profile print media as in claim 19 wherein the assembly is releasably adhered to the magazine or book cover to allow the image and substrate to be removed therefrom and applied to another object.

21. Print media with enhanced realism via a three-dimensional effect comprising a sheet having on a first surface thereof a background picture, a foreground picture of a person or object on a substrate which is cut to form a profile of the person or object and forming a profile edge substantially all of which is adhered directly to the first surface of the sheet, the foreground picture being on a surface slightly spaced by the substrate from the background picture, and the substrate providing a substantially continuous profile edge aligned with the profile of the person or object which is close to perpendicular to the surface of the sheet and which, when illuminated, provides a shadow around the foreground picture to provide a three-dimensional effect, the substrate is bonded directly over and aligned with a picture of a person or object in the background which is substantially identical to the foreground picture, the profile edge is perpendicular to the first surface of the sheet, and the thickness of the foreground picture and substrate is within the range of three to twenty thousandths of an inch thickness per one inch of length measured at the longest points.

22. Print media as in claim 21 wherein said sheet comprises the cover of a magazine, and the substrate is adhered to the sheet by an adhesive which allows the substrate to be peeled off from the sheet for attachment to another object.

23. Print media as in claim 21 wherein the sheet has a second surface having printed thereon a compilation of biographical information of a sports team.

24. A profile product comprising an image adhered to a product having a background, the image comprising an image of an action photograph of a sports player, the image being bonded on a substrate, and the image and the substrate being cut around the profile of the player, the edge of the image and the substrate being substantially coincidental and perpendicular to the surface of the image and forming a substantially continuous profile edge, the thickness of the image and substrate being within the range of three to twenty thousandths of an inch thickness per one inch of length measured at the longest points.

25. A product as in claim 24 wherein the image and substrate assembly is releasably adhered to the product to allow the image and substrate to be removed therefrom and applied to an object.

26. A product as in claim 25 wherein the assembly has a back side opposite its image side and the back side having thereon an advertising message which is hidden until the assembly is removed from the product.

27. A profile card comprising an image adhered to a card having a background, the image comprising an image of an action photograph of a sports player, the image being bonded on a substrate, and the image and the substrate being cut around the profile of the player, the edge of the image and the substrate being substantially coincidental and perpendicular to the surface of the image and forming a substantially continuous profile edge, the thickness of the image and substrate being within the range of three to twenty thousandths of an inch thickness per one inch of length measured at the longest points.

28. A card as in claim 27 wherein the image and substrate assembly is releasably adhered to the card to allow the image and substrate to be removed therefrom and applied to an object.

* * * * *

US005421583C1

(12) EX PARTE REEXAMINATION CERTIFICATE (5928th)

United States Patent
Gluck

(10) Number: US 5,421,583 C1
(45) Certificate Issued: Oct. 9, 2007

(54) PRINT MEDIA PRODUCTS WITH ENHANCED REALISM

(75) Inventor: Adrian Gluck, Newport Beach, CA (US)

(73) Assignee: Media Technologies Licensing, LLC, Beverly Hills, CA (US)

Reexamination Request:
No. 90/008,072, Jun. 29, 2006

Reexamination Certificate for:

| | |
|---|---|
| Patent No.: | **5,421,583** |
| Issued: | **Jun. 6, 1995** |
| Appl. No.: | **08/192,438** |
| Filed: | **Feb. 7, 1994** |

Related U.S. Application Data

(63) Continuation-in-part of application No. 08/147,139, filed on Nov. 3, 1993, now Pat. No. 5,417,431.

(51) Int. Cl.

| | |
|---|---|
| ***B42D 15/02*** | (2006.01) |
| ***A47G 1/17*** | (2006.01) |
| ***A63H 33/38*** | (2006.01) |

(52) U.S. Cl. ..... 273/293; 40/124.19; 40/1; 40/594; 40/743; 273/282.2; 283/117; 446/147; 446/901

(58) Field of Classification Search ..... None
See application file for complete search history.

(56) References Cited

PUBLICATIONS

Fleer 1990 Baseball Collectors Pin.
Fleer 1990 Basketball Collectors Pin.
Fleer 1990 Football Collectors Pin.
1990 Jim Abbot MVP Major League Collector Pin.
1990 Mark McGwire MVP Major League Collector Pin.
1990 Ryne Sandberg MVP Major League Collector Pin.
1991 Andre Dawson MVP Major League Collector Pin.
1991 Carlton Fisk Major League Collector Pin.
1991 Mark Grace Major League Collector Pin.

*Primary Examiner*—Michael O'Neill

(57) ABSTRACT

There is disclosed herein a new form of print media product which provides enhanced realism through a three-dimensional effect. It includes a master sheet or card having a background picture, along with a picture of a person or an object printed or disposed on a substrate and which substrate is directly adhered to the surface of the card to provide a substantially continuous profile edge around the picture and which edge preferably is substantially perpendicular to the surface of the background picture. This arrangement enables a shadow to exist along this profile edge and to give an enhanced three-dimensional effect. In the case of a trading card, the reverse side preferably has detailed biographical information and detailed life sports statistics. In alternative embodiments, the profile item formed by the picture and its substrate can be removable from another object such as a magazine cover. In other embodiments, the profile can have an opening therein, or be in the form of a box or the like, to allow a material object to be inserted and removed therefrom. In each instance, the profile (picture and its substrate) is relatively thin and flexible to allow the object (e.g., trading card, post card, magazine cover, etc.) to be flexed without destroying or deteriorating the combination of the profile and underlying card or other object.

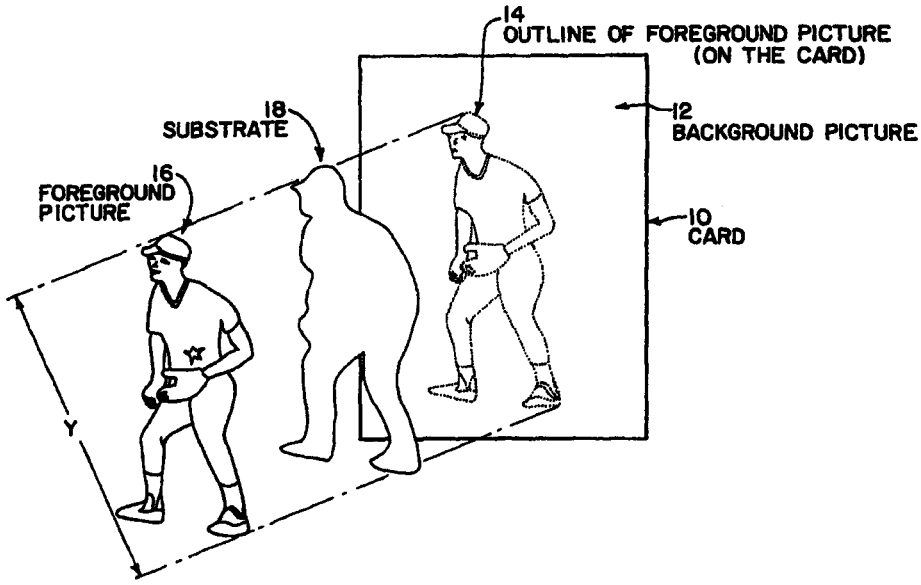

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–28 is confirmed.

* * * * *